US011654340B2

(12) United States Patent
Meredith

(10) Patent No.: US 11,654,340 B2
(45) **Date of Patent: *May 23, 2023**

(54) HITTING PRACTICE DEVICE

(71) Applicant: Alan Scott Meredith, South Bend, IN (US)

(72) Inventor: Alan Scott Meredith, South Bend, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/240,720

(22) Filed: Apr. 26, 2021

(65) Prior Publication Data

US 2021/0299536 A1 Sep. 30, 2021

Related U.S. Application Data

(63) Continuation of application No. 15/986,269, filed on May 22, 2018, now Pat. No. 10,987,561.

(60) Provisional application No. 62/509,911, filed on May 23, 2017.

(51) Int. Cl.
*A63B 69/00* (2006.01)
*A63B 102/18* (2015.01)

(52) U.S. Cl.
CPC ..... *A63B 69/0002* (2013.01); *A63B 69/0075* (2013.01); *A63B 2069/0008* (2013.01); *A63B 2102/18* (2015.10); *A63B 2102/182* (2015.10)

(58) Field of Classification Search
CPC ..... A63B 69/0002; A63B 2102/18; A63B 2102/182; A63B 2069/0008
USPC ..... 473/451, 422
See application file for complete search history.

(56) References Cited

U.S. PATENT DOCUMENTS 3,877,697 A * 4/1975 Lersch ..... A63B 57/10 473/417
4,364,563 A * 12/1982 Stafford ..... A63B 69/0075 473/417
4,445,685 A * 5/1984 Cardieri ..... A63B 69/0075 473/417
4,819,937 A * 4/1989 Gordon ..... A63B 69/0075 473/417
4,830,371 A * 5/1989 Lay ..... A63B 69/0091 473/423
4,938,478 A * 7/1990 Lay ..... A63B 69/0091 473/423
5,467,978 A * 11/1995 Paluch ..... A63B 69/0079 473/429
5,470,055 A * 11/1995 Ritchie ..... A63B 69/0002 473/277
5,540,430 A * 7/1996 Nichols ..... A63B 69/0002 473/417
6,045,462 A * 4/2000 Mourek ..... A63B 69/0075 473/417

(Continued)

*Primary Examiner* — Mitra Aryanpour

(57) ABSTRACT

A hitting practice device allows a batter to swing the bat, make contact with the device, and then to follow-through with the swing while maintaining contact with the device. In embodiments, the hitting practice device includes a pivoting base, a post connected to the base, a pad attached at the upper portion of the post, and a stopper that prevents the base from pivoting beyond a recovery angle. In other embodiments, the base includes a base plate and stabilization plate connected by a hinge. In embodiments, a pad and dampener absorb most of the initial impact of the hit, pausing the swing for analysis. The pivoting base then allows the batter to continue, follow-through and complete the swing.

20 Claims, 11 Drawing Sheets

(56) References Cited

U.S. PATENT DOCUMENTS

| | | | | |
|---|---|---|---|---|
| 6,435,990 | B1 * | 8/2002 | Bradley | A63B 69/0002 473/422 |
| 7,070,520 | B1 * | 7/2006 | An | A63B 69/0091 473/459 |
| 7,204,769 | B2 * | 4/2007 | Bandimere | A63B 69/0075 473/422 |
| 7,479,074 | B1 * | 1/2009 | Pierce | A63B 69/0002 473/422 |
| 8,109,844 | B1 * | 2/2012 | Quinn | A63B 69/0075 473/422 |
| 8,784,239 | B2 * | 7/2014 | Harvey | A63B 69/0002 473/422 |
| 8,784,240 | B1 * | 7/2014 | Buono | A63B 69/0079 473/422 |
| 10,004,967 | B1 * | 6/2018 | Paulson | A63B 69/0002 473/417 |
| 10,682,560 | B1 * | 6/2020 | Huang | A63B 69/0075 473/417 |
| 10,987,561 | B1 * | 4/2021 | Meredith | A63B 69/0002 473/417 |
| 2007/0049426 | A1 * | 3/2007 | Huang | A63B 69/0002 473/417 |
| 2013/0210554 | A1 * | 8/2013 | Carlson | A63B 69/0002 473/417 |
| 2014/0302948 | A1 * | 10/2014 | Holland | A63B 69/0002 473/417 |

* cited by examiner

HITTING PRACTICE DEVICE

CROSS-REFERENCE TO RELATED APPLICATIONS

This application is a continuation of U.S. patent application Ser. No. 15/986,269, filed on May 22, 2018, the disclosure of which is herein incorporated by reference. This application claims the benefit of the filing date of U.S. provisional patent Ser. No. 62/509,911, filed on May 23, 2017, entitled "Hitting Training Tool," the disclosure of which is herein incorporated by reference.

BACKGROUND

Many sports such as baseball, softball, cricket, stickball, tennis, etc. involve hitting a ball using a bat, racket or paddle. Players try to hit the ball with a desired speed, angle or force for the best possible results. Numerous devices, such as hitting tees, have been developed over the years to enable players to practice and improve their form. Players also may use a hitting drill known as the "bag drill" to improve their hitting form. This drill involves the baseball or softball player swinging a bat until the bat makes contact with a traditional punching bag. Once the bat makes contact with the bag, the baseball or softball player stops the swing, and the coach corrects the athlete's form. Players and coaches are constantly looking for devices and techniques to improve form, accuracy and strength.

BRIEF SUMMARY

The following presents a simplified summary in order to provide a basic understanding of some aspects of the claimed subject matter. This summary is not an extensive overview. It is not intended to either identify key or critical elements or to delineate the scope of the claimed subject matter. Its sole purpose is to present some concepts of the innovation in a simplified form as a prelude to the more detailed description that is presented later.

Embodiments of the described devices allow a batter to swing the bat, make contact with the device, and then to follow-through with the swing while maintaining contact with the device. In embodiments, a hitting practice device includes a pivoting base, a post connected to the base, a pad attached at the upper portion of the post, and a stopper that prevents the base from pivoting beyond a recovery angle. In other embodiments, the base includes a base plate and stabilization plate connected by a hinge, where the base plate rotates relative to the stabilization plate to pivot the base. A pad and dampener can absorb all or most of the initial impact of a hit, pausing the batter's swing for analysis. The pivoting base then allows the batter to continue, following-through and completing the swing.

In embodiments, the base plate and the stabilization plate are connected by the hinge, such that the base plate may pivot with respect to stabilization plate. In embodiments, stabilization plate remains substantially in contact with a surface supporting the device as the base plate pivots in response to a batter making contact with the device. In other embodiments, the stabilization plate is not present, and the base plate is connected directly to the supporting surface by hinge, such that the base plate may pivot with respect to the supporting surface.

In embodiments, the post is covered at least in part by a pad that assists in absorbing the initial contact of a hit. In embodiments, the post comprises a lower portion, an upper portion, and an impact dampener, the impact dampener being capable of storing mechanical energy. When a batter uses the device, the bat makes contact with the pad before the batter follows through with the swing. As the batter follows through, the pad and impact dampener absorb the impact of the hit of a bat, and the base plate pivots with respect to the stabilization plate upon follow-through by the batter.

In some embodiments, the base plate and the stabilization plate lie adjacent to each other when the device is at rest, and the base plate pivots toward the stabilization plate as the batter follows through with the swing and the bat pushes the pad. In other embodiments, the base plate lies on top of the stabilization plate when the device is at rest and the base plate pivots away from the stabilization plate as the batter follows through with the swing and the bat pushes the pad. Weights, a resistance band, or a resistance spring can be used to add resistance to the pivot of the base plate and the follow-through.

In embodiments, the device includes a stopper that prevents the base plate from pivoting beyond a recovery angle, wherein the recovery angle is the maximum angle at which the device will return to the resting state on its own once the batter no longer makes contact with the device. In some embodiments, the stopper comprises a limit in the hinge that prevents the hinge from rotating beyond the recovery angle. In other embodiments, the stopper comprises a leg, wherein the leg is connected to the post and extends outward so as to prevent the base plate from pivoting beyond the recovery angle. In other embodiments, the device includes a mock home plate that can be positioned to assist the player in judging their stance and practice hitting at various angles and for a variety of pitch locations.

To the accomplishment of the foregoing and related ends, certain illustrative aspects of the claimed subject matter are described herein in connection with the following description and the annexed drawings. These aspects are indicative of various ways in which the subject matter may be practiced, all of which are intended to be within the scope of the claimed subject matter. Other advantages and novel features may become apparent from the following detailed description when considered in conjunction with the drawings.

BRIEF DESCRIPTION OF THE DRAWINGS

The hitting practice device may be better understood by referring to the following description in conjunction with the accompanying drawings, in which like numerals indicate like structural elements and features in various figures. The components in the figures are not necessarily to scale, and simply illustrate the principles of the device. The accompanying drawings illustrate only possible embodiments of the device and are therefore not to be considered limiting in scope.

DETAILED DESCRIPTION

Aspects of the hitting practice device are described below with reference to illustrative embodiments. The references to illustrative embodiments below are not made to limit the scope of the claimed subject matter. Instead, illustrative embodiments are used to aid in the description of various aspects of the device. The description, made by way of example and reference to illustrative reference is not meant to be limiting as regards any aspect of the claimed subject matter.

Baseball and softball practice generally includes batting tees or a bag drill, where players hit a weighted bag. The bag drill, when used with a traditional punching bag, is problematic because the weight of the bag prevents the baseball or softball player from following through and completing the swing motion after the player's form is corrected. In addition, a traditional punching bag is firm and heavy, providing little or no "give" when struck with the bat. This can strain the player's shoulder and arm muscles after just a few repetitions. There is a need for a hitting practice device that allows baseball and softball players to follow through with their swing after making contact with the device. In addition, there is a need for a hitting practice device with which baseball and softball players can make contact multiple times without straining the player's muscles.

Figure 1:
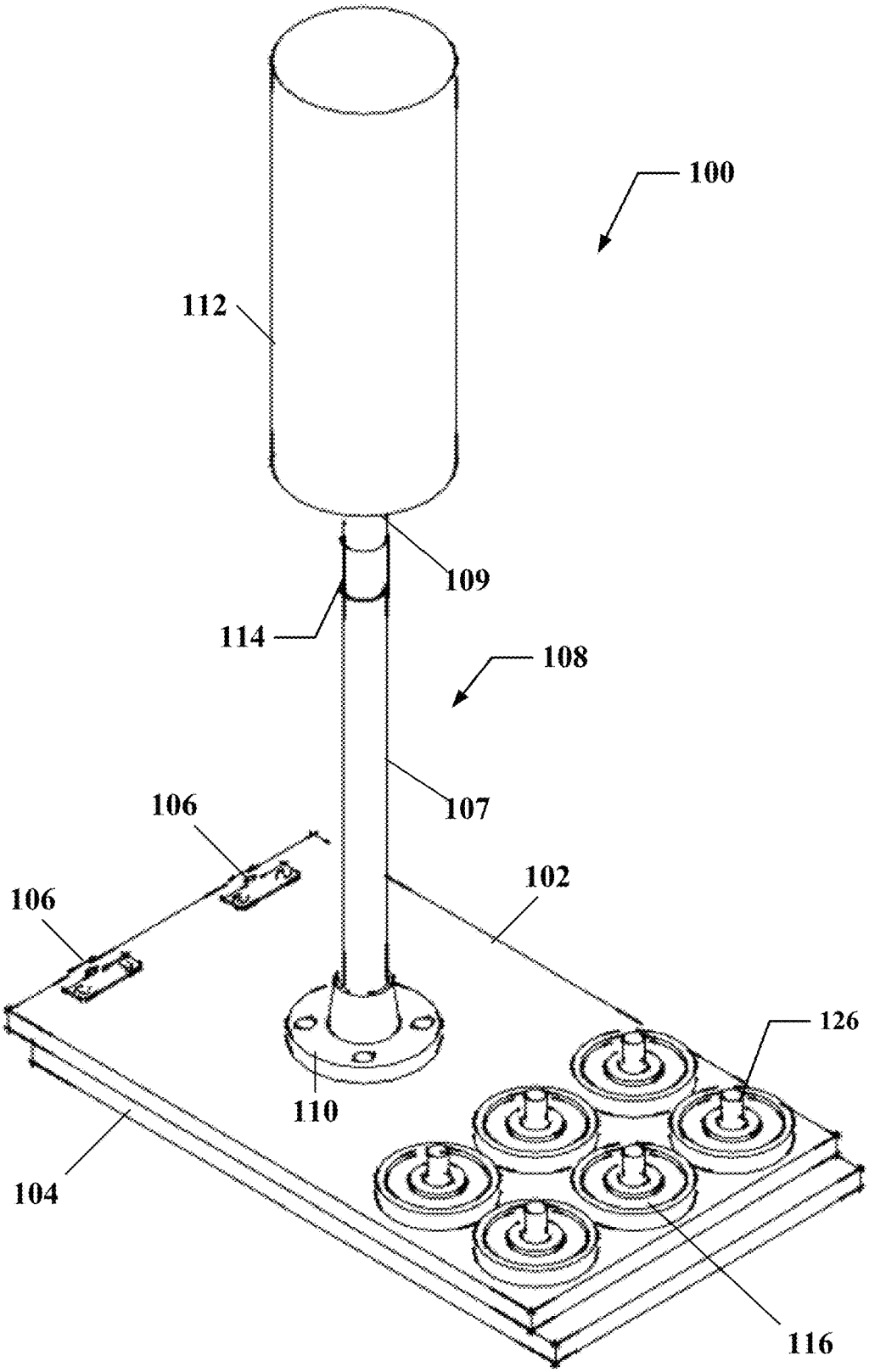
FIG. 1 depicts an embodiment of a hitting practice device in the resting state.

FIG. 1 illustrates a hitting practice device 100 for improving an individual's batting form and strength, particularly for baseball and softball players, although the benefits of using this device 100 may extend to other professions and recreational activities as well. The device 100 allows a batter to swing the bat, make contact with the device 100, pause to check or correct stance and form, and then follow-through with the swing. As discussed in detail below, in embodiments the hitting practice device 100 includes a pad 112 attached to a post 108, where the post 108 is supported by a pivoting base that enables the pad 112 and post 108 to pivot relative to the surface on which the device 100 is resting to follow-through and complete their swing. When a player practices hitting, they swing a bat and strike the pad 112, preferably at the height and angle at which they would make contact with the ball during play. The initial impact of this strike can be absorbed at least in part by the pad 112 and potentially by an impact dampener 114 that flexes upon impact of the bat on the device 100. If the swing is paused here, a coach can review the form of the player, or a camera can catch the player's form, allowing for evaluation and potentially adjustment of the player's stance or swing. After the pause, the player can continue the motion of the bat forward, causing the post 108 to pivot and allowing the player to practice their follow-through. Weights, resistance bands, springs or other resistance devices can oppose the pivot motion of the post 108, providing strength training. The device 100 enables the player to practice using a full swing and avoids strain or jarring of the player's shoulders, arms and back.

Turning again to FIG. 1, the hitting practice device 100, in one embodiment, includes a pad 112 and an impact dampener 114. The pad 112 acts both as a target for the player swinging the bat, and absorbs at least part of the impact of the bat. The pad 112 is attached to a post 108, that can include a lower portion 107 and an upper portion 109 connected via the impact dampener 114, which absorbs at least part of the initial contact of the hit. The post 108 is connected to a pivoting base, formed here by a base plate 102 connected to a stabilization plate 104 via one or more hinges 106. Impact of the bat causes the base plate 102 to rotate on the hinges 106, which causes the post 108 and dampener 114 to rotate, allowing the batter to continue their follow-through and complete their swing. One or more weights 116 can be attached to the base plate 102 to increase the resistance to rotation of the base plate 102 and post 108. This resistance can assist the batter in pausing their swing at or near the point of contact with the device 100, allowing for evaluation and correction of form and stance.

FIG. 1 depicts an embodiment of the hitting practice device 100 where the base plate 102 lies on top of stabilization plate 104 in the resting state. In this resting state the device 100 is ready for use and the batter assumes a batting stance relative to the device 100. The batter lines up so that the point of contact between the batter's bat and the pad 112 represents the point of contact between the batter's bat and a ball being pitched during a game-time situation. A batting coach can watch the batter from any angle offering advice and instruction at any point before, during or after the batter's swing. The pad 112 and impact dampener 114 absorb some of the impact of force applied by the bat to the device 100, which helps the batter avoid injury or strain caused by jarring during repeated hits against the device 100. Once the batter makes contact with the pad 112, the pad 112 and dampener 114 can allow the batter to halt their swing. Optionally with the assistance of a coach or other player, the batter is able to review and correct the position of his or her feet, hips, arms, legs, or whole body while maintaining substantial contact between the bat and the pad 112. In an embodiment, the batter practices their swing at half or partial speed. The initial contact with the pad 112 stops the swing, allowing the batter to use their natural motion in the swing then stopping at the point of contact for evaluation and correction. The batter can then follow-through using the device 100 to complete the swing, with resistance from the device 100 providing strength training.

Figure 2:
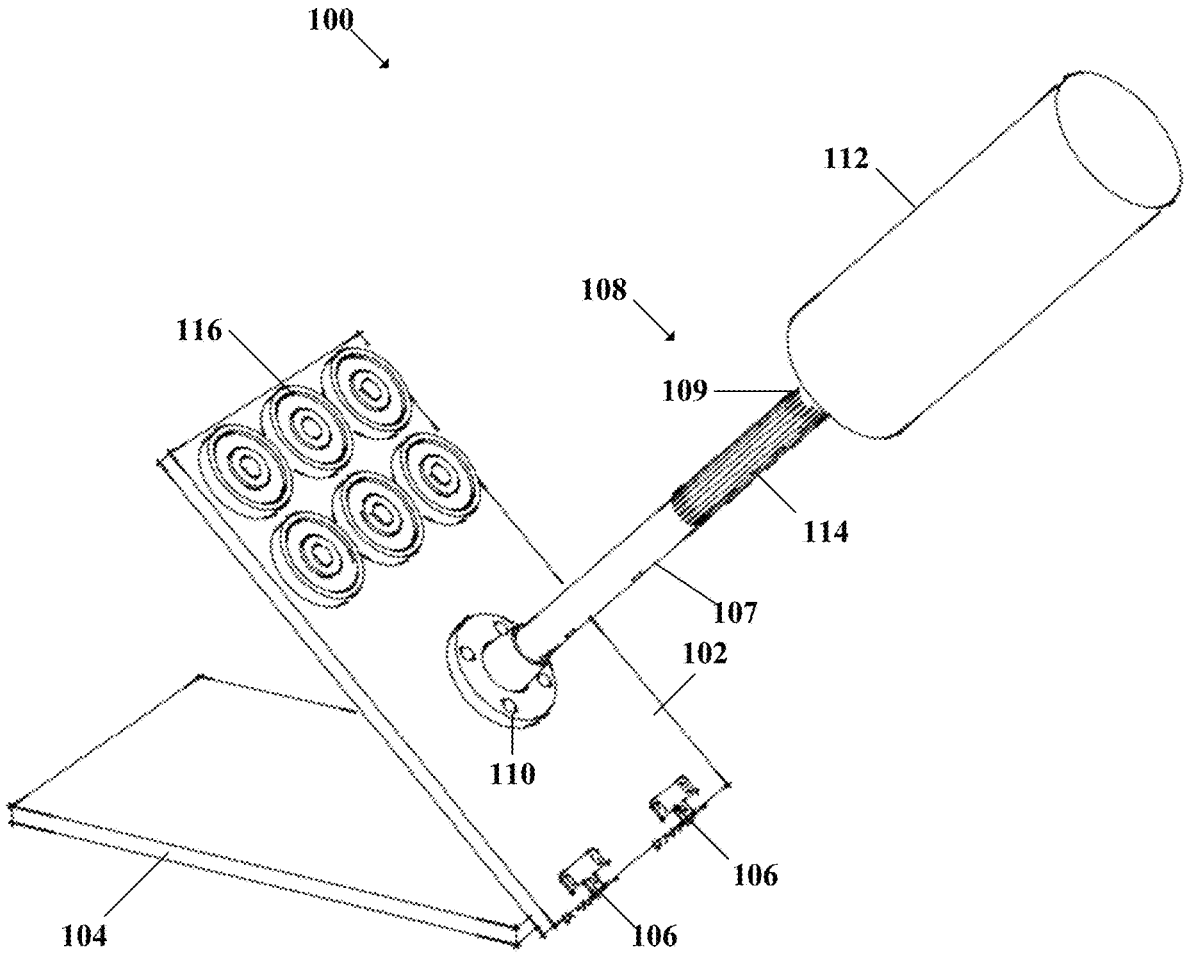
FIG. 2 depicts an embodiment of the hitting practice device in the stopped state.

FIG. 2 depicts the embodiment of the hitting practice device 100 of FIG. 1 after the batter begins to follow through with the swing and the device 100 leaves the resting state. Here, initial contact by the bat was made and the impact absorbed by the pad 112 and/or the impact dampener 114. The hinge 106 allows the batter to follow-through after the point of contact, causing the base plate 102 to pivot relative to the stabilization plate 104. In the embodiment of FIG. 2, the base plate 102 pivots at the hinge, lifting away from stabilization plate 104 as the batter follows through with the swing. When the base plate 102 has reached a predetermined angle, a limit in the hinge 106 prevents further rotation of the hinge 106, causing the base plate 102 to stop rotating relative to the stabilization plate 104. At this point, the base plate 102 has not pivoted beyond a recovery angle, so the base plate 102 will naturally fall back into the resting position depicted in FIG. 2. The recovery angle is the maximum angle at which the device 100 will return to the resting state on its own once the batter no longer makes contact with the device 100.

In some embodiments, the stabilization plate 104 is fixed to the ground for stability. If the device 100 is to be used on a soft surface, such as grass or earth, this can be accomplished by using stakes protruding from or inserted through the stabilization plate 104 and extending into the supporting surface. If the device is to be used on a hard surface, the stabilization plate 104 can be fixed to the ground with bolts, adhesives, or other types of fasteners. In other embodiments, the underside of the stabilization plate 104 is not fixed to the ground, but has a larger surface area or is weighted to provide for more stability. In some embodiments, additional plates may be attached to the bottom of the stabilization plate 104 to increase the surface area in contact with the supporting surface. In some embodiments, the underside of the stabilization plate 104 has a high coefficient of friction in order to prevent the device 100 from sliding when in use.

In another embodiment, the hinges 106 can be attached to the ground or surface upon which the device 100 rests, and the device 100 can be used without the stabilization plate 104. In one such embodiment, the hinges 106 can be attached to the ground via one or more spikes or stakes that can be hammered into the ground.

In embodiments, the base plate 102 and stabilization plate 104 and are connected by a one or more hinges 106, as illustrated in FIG. 1, or any other mechanism that allows the base plate 102 to pivot about an axis between the base plate 102 and stabilization plate 104 while remaining attached to the stabilization plate 104. The hinge 106 allows the stabilization plate 104 to remain in contact with the supporting surface while the base plate 102 pivots as the batter follows through with the swing. In embodiments, the hinge 106 is be configured to limit the angle through which the base plate 102 can pivot with respect to the stabilization plate 104. In such embodiments, the hinge 106 acts effectively as a stopper that prevents the device from tipping past the recovery angle. In other embodiments, the device may include alternative or additional stoppers, as described below with respect to FIG. 10

As depicted in FIG. 1, in embodiments, the hitting practice device 100 includes a post 108, which is connected to the base plate 102 by a connector 110. The connector 110 holds the post 108 in place substantially perpendicular to the base plate 102. The connector 110 can be a neck flange or any comparable connector suitable for holding the post 108 substantially perpendicular to the base plate 102. In some embodiments, the post 108 comprises a plurality of connected portions, including a lower portion 107 and an upper portion 109. In other embodiments, the post 108 is a single piece.

In embodiments, a pad 112 covers at least part of the post 108. The pad 112 can be made of any material capable of softening the impact of a hit including, but not limited to, a cushion, cushioned bag, pad, inflated bag, fabric, sand or grain bag, and foam. In some embodiments, the pad 112 completely encloses the entire circumference of the post 108. In other embodiments, the pad 112 only covers part of the post 108, such as the part that comes in contact with the bat. In some embodiments, the pad 112 extends along the entire length of the post 108, while in other embodiments the pad 112 extends along only part of the length of the post 108. In some embodiments, the pad 112 is weighted so as to provide resistance to the follow through motion of a swing, while in other embodiments, the pad 112 is lightweight, so that the pad 112 can be easily transported.

In embodiments, the post 108 comprises a lower portion 107 and an upper portion 109 connected by an impact dampener 114, such as a spring or other elastic material that connects the lower portion 107 of the post 108 to the upper portion 109. The impact dampener 114 may be a spring or any other elastic material capable of storing mechanical energy when the pad 112 is struck by the batter. Examples of other elastic materials include, but are not limited to, elastomers such as natural rubber and synthetic rubber. In some embodiments, a casing encloses the top of the lower portion 107 of the post 108, the impact dampener 114, and the bottom of the upper portion 109 of the post 108. In embodiments where the impact dampener 114 comprises a spring, the casing protects the spring and may also prevent fingers or other items from getting caught and pinched in the spring. The casing can be made of any flexible material, such as rubber. In some embodiments, a casing encloses at least part of one or more of the impact dampener 114, the lower portion 107 of the post 108, and the upper portion 109 of the post 108.

In some embodiments, the post 108 is collapsible or detachable from the base plate 102 for easier transportation and storage. In embodiments, upper portion 109 of the post 108 is collapsible or detachable from one or more of the impact dampener 114, the lower portion 107 of the post 108, and the pad 112. In some embodiments, the upper portion 109 of the post 108, the lower portion 107 of the post 108, and the impact dampener 114, can be detached from one another for easier transportation and storage. In some embodiments, the upper portion 109 of the post 108, the lower portion 107 of the post 108, and the impact dampener 114, can be collapsible relative to one another for easier transportation and storage. In some embodiments, the lower portion 107 of the post 108 is detachable from the connector 110. In some embodiments, the connector 110 is detachable from the base plate 102. The term "detachable," "detach," or "detached" should be understood as meaning that the component may perform one or more of detaching, folding closed, unfastening, unlocking, unpinning, disengaging, unscrewing, unhitching, or other means by which the component is either detached from one or more other components or is internally detached into one or more subcomponents or into a more compact or collapsible state.

Figure 8:
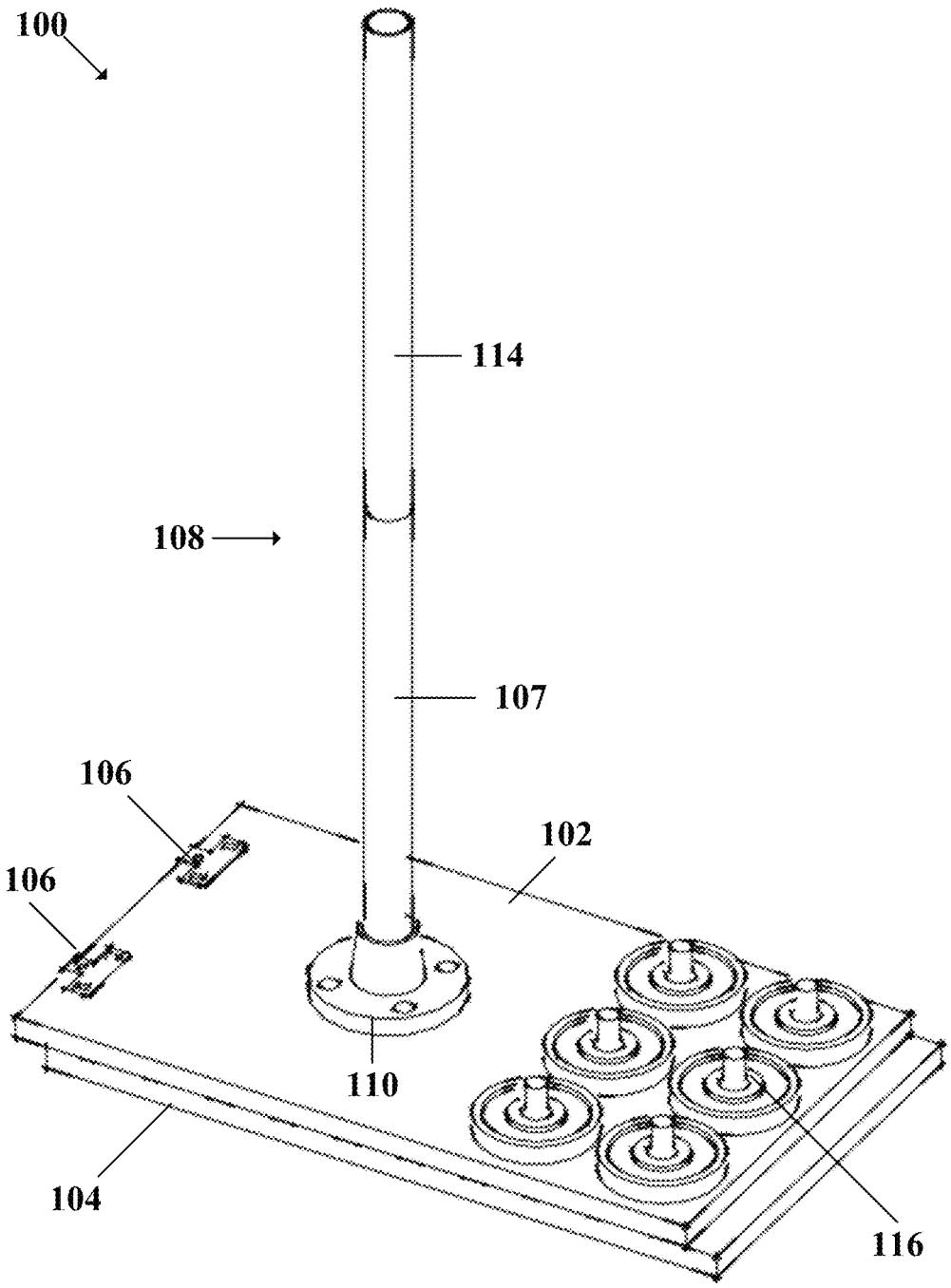
FIG. 8 depicts an embodiment of the hitting practice device where the pad and the upper portion of the post are detached and removed from the device.

As illustrated by FIG. 8, in some embodiments, the upper portion 109 and pad 112 are detachable and can be removed. Such a configuration allows for the pad 112 to be replaced with another pad 112 having different mass, firmness, or other attribute. For example, it may be desirable to use a pad having a greater mass when the device is to be used in a stationary setting, but a pad 112 having a lesser mass when the device is to be transported. When the upper portion 109 and pad 112 are detached, the device may also function as a tee on which a baseball or softball can be placed.

In some embodiments, the post 108 is height-adjustable. This height adjustment allows the device to be used by a wide variety of batters, including children, teenagers, and adults of varying heights. In addition, height could be adjusted to allow the batters to practice hitting pitches or targets thrown at varying heights. Height adjustment could be accomplished by a number of ways, including, but not limited to, raising or lowering an upper portion 109 that slides into or out of a lower portion 107 of the post 108, raising or lowering a lower portion 107 that slides into or out of a second upper portion 109 of the post 108, or using a telescoping upper and lower portions of the post 108. In embodiments, the desired height can be secured through an adjustable locking mechanism. The adjustable locking mechanism can operate through one or more of a pin that passes through one or more posts, a clamp that holds the height-adjustable post or posts in place, or by any other tightening or fastening mechanism available to those of skill in the art.

In some embodiments, the base plate 102 can be fitted with one or more weight holders 126 for adjustable weight resistance training. The one or more holders 126 can be in any form suitable for securing weights 116 to the base plate 102 during the follow-through motion. In one embodiment, the one or more weight holders 126 can comprise one or more pegs. Weights 116 are attached by placing each weight 116 on a peg via a hole in the weight 116. In another embodiment, the one or more weight holders 126 are compartments, enclosed on one or more sides. In another embodiment, the one or more weight holders 126 can comprise one or more fasteners, including but not limited to elastic bands or a hook and loop fastener (e.g., Velcro®), that secure the one or more weights 116 to the base plate 102. In another embodiment, one or more weight holders 126 can comprise a combination of one or more of a peg, a compartment, and a fastener.

Weight resistance training can also be accomplished by using resistance bands or springs to oppose pivoting of the base plate 102. In embodiments, the weights, resistance bands or springs can be selected to vary the resistance to the pivoting of the base of the device 100 during the follow-through, and providing weight training as well as form evaluation and correction.

Figure 3:
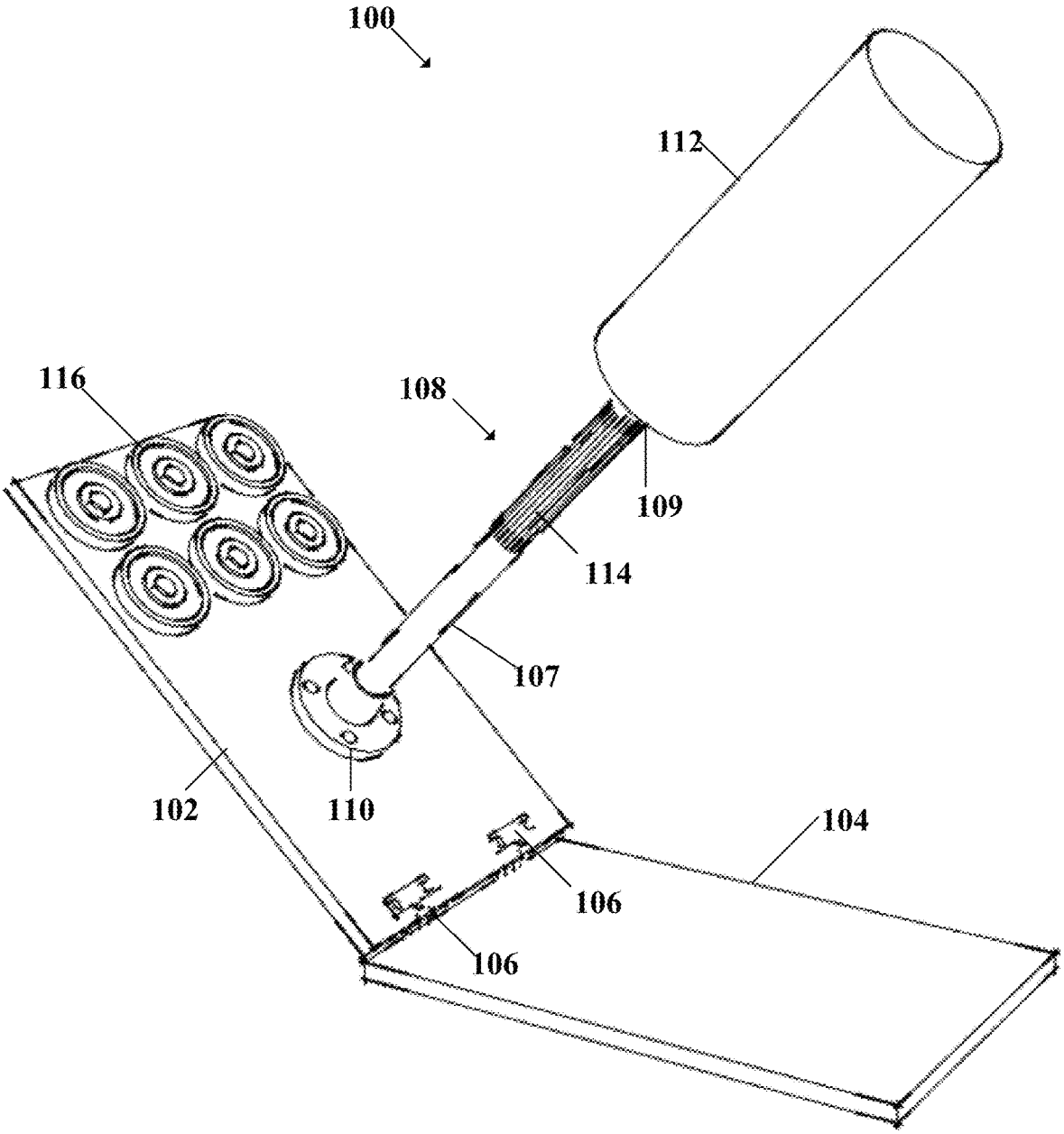
FIG. 3 depicts another embodiment of the hitting practice device where the base plate is adjacent to the stabilization plate.
Figure 5:
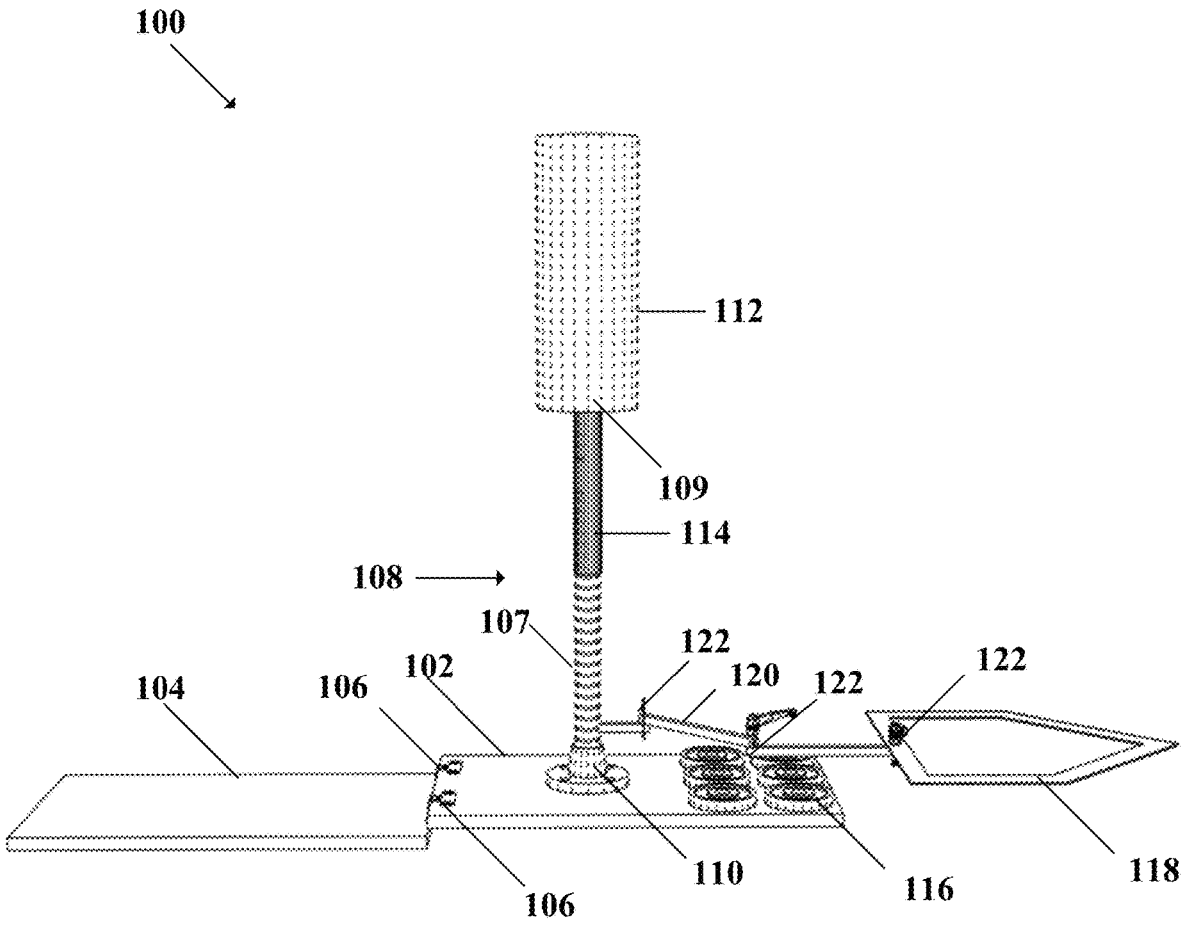
FIG. 5 depicts an embodiment of the hitting practice device of FIG. 4 in the resting state, prior to when the bat makes contact with the device.

Referring to FIG. 3, in embodiments, the base plate 102 and stabilization plate 104 are side by side, rather than stacked as shown in FIG. 1. When the device 100 is hit, the stabilization plate 104 remains in contact with a surface supporting the device 100 for stability while the base plate 102 pivots as the batter follows through with the swing. While the base and stabilization plates are shown as generally rectangular and roughly equal in size, they can be any suitable size and shape. Indeed, the pivoting base can be any suitable shape that allows the base to rotate or pivot during the follow-through. As depicted in FIG. 5, in embodiments, the base plate 102 and stabilization plate 104 lie adjacent to each other, with each plate resting on the supporting surface when the device is in the resting state, and the base plate 102 pivots toward the stabilization plate 104 when the batter follows through with the swing, as shown in FIG. 3.

Figure 4:
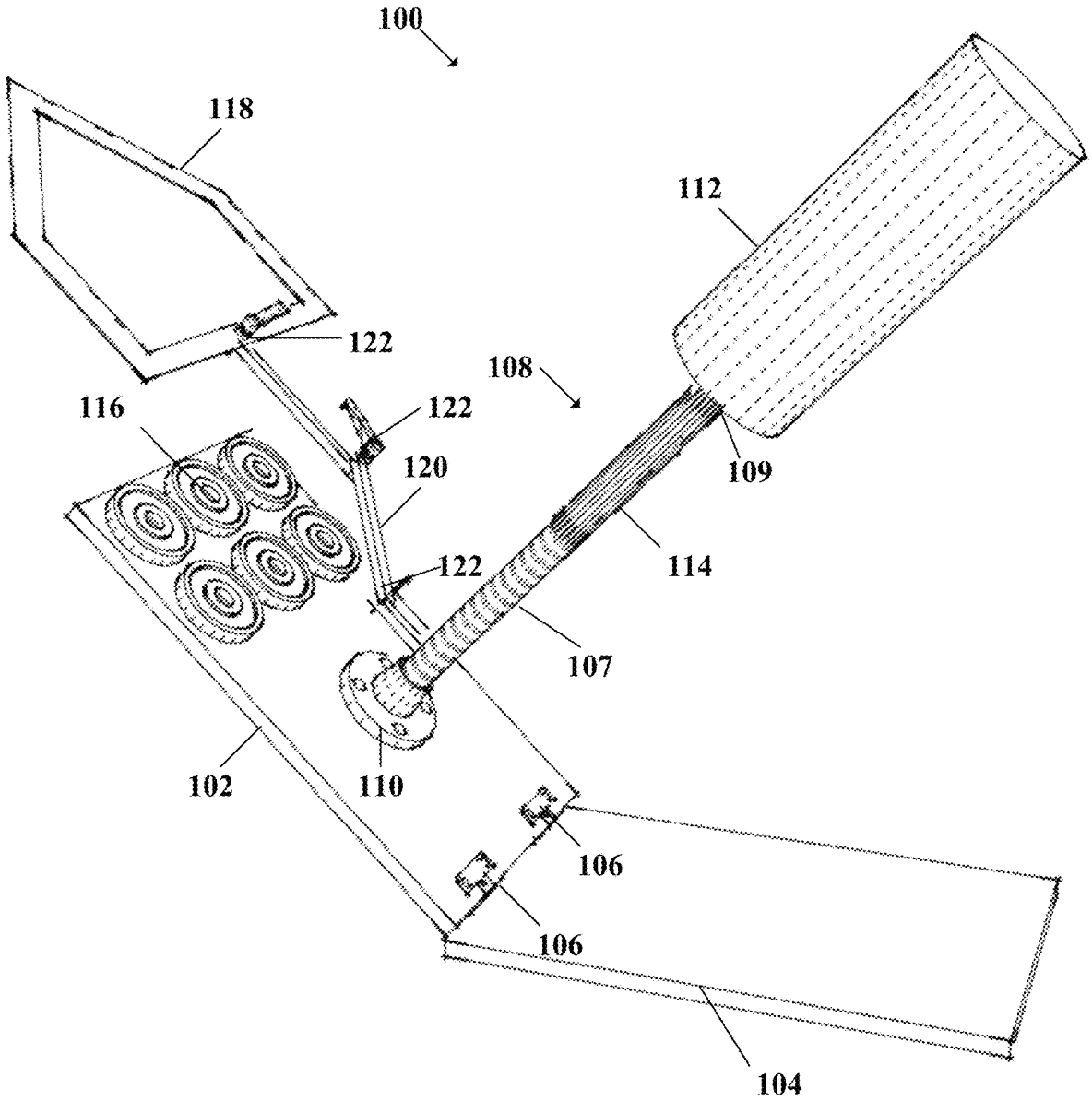
FIG. 4 depicts an embodiment of the hitting practice device with a home plate attachment.

Turning now to FIGS. 4-7, in embodiments, the hitting practice device 100 includes an adjustable mock home plate 118. The mock home plate 118 allows the batter to visualize where to stand with respect to the device 100 as if he or she were standing over an actual home plate. In embodiments, the mock home plate 118 is substantially the same size and shape as a home plate typically used in baseball or softball. In other embodiments, the mock home plate 118 may be another shape or size that allows the batter visualize where to stand with respect to the device. In embodiments, the position of the mock home plate 118 may be adjusted with respect to the hitting practice device 100. The mock home plate 118 is connected to the device by an arm 120, which comprises one or more segments. In embodiments, the arm 120 has one or more adjustable joints 122. As depicted in FIG. 4, the adjustable joints 122 can be located at the point where the arm 120 and mock home plate 118 connect, the point where the arm 120 connects to the device, or at points between different segments of the arm 120. The adjustable joints 122 allow the mock home plate 118 and arm 120 to pivot about the axes of the joints 122, which are substantially vertical when the hitting practice device 100 is in the resting state, allowing the mock home plate 118 to be translated within a substantially horizontal plane. In embodiments, the joints 122 may comprise a bolt which can be tightened to secure the position of the mock home plate 118. In other embodiments, the joints 122 comprise another mechanism available to those skilled in the art that allow the joints 122 to be adjusted when the device is not in use and secured when the device is in use. As shown in FIG. 4, in embodiments, the arm 120 connects to the device near the lower end of the post 108, the connector 110 or the base plate 102.

The adjustable mock home plate 118 assists the batter to practice hitting pitches directly over home plate, or to some degree closer to or farther from the batter. To train to hit pitches in the center of the strike zone, the mock home plate 118 can be aligned or positioned directly behind the post 108 with respect to the direction the base plate 102 pivots to train. To train to hit "outside" pitches, which are on the opposite side of strike zone as the batter, the mock home plate 118 can be adjusted to be closer to the batter with respect to the device, where the batter stands in the same position with respect to the mock home plate 118 but the device is farther away from the batter. To train to hit "inside" pitches, which are closer to the batter than the strike zone, the mock home plate 118 can be adjusted to be farther from the batter with respect to the device 100, where the batter stands in the same position with respect to the mock home plate 118, but the post 108 and pad 112 are closer to the batter.

Additionally, the adjustable mock home plate 118 assists the batter training to hit the ball in a certain direction. When the mock home plate 118 is positioned directly behind the post 108 with respect to the direction the base plate 102 pivots, as depicted in FIG. 4, the device will pivot straight forward from where the batter stands, simulating the motion of hitting the baseball or softball straight ahead. Alternatively, the mock home plate 118 may be positioned at an angle offset from the direction the base plate 102 pivots. In this case, the device will pivot an angle from where the batter stands, simulating the motion of hitting the baseball or softball at an angle, thus allowing the batter to aim the hit the baseball or softball in a certain direction. These aspects allow for the batter to train to hit pitches in different positions with respect to the strike zone in different directions as hitting strategy may suggest.

Referring again to FIGS. 5-7, embodiments of the hitting practice device 100 are depicted at the various stages or states in which the hitting practice device 100 is used during a hitting exercise, including, in FIG. 5, the resting state prior to the batter making contact with the device 100, in FIG. 6, the intermediate state during the batter's follow-through when the batter is making contact with the pad 112, and in FIG. 7, the stopped state at which the stopper prevents base plate 102 from pivoting further with respect to stabilization plate 104.

FIG. 5 depicts an embodiment of the hitting practice device 100 in the resting state, prior to when the bat makes contact with the device 100. The mock home plate 118 is positioned directly behind the post 108 with respect to the direction of movement of the base plate 102, indicating that the device 100 is to be hit straight forward. In this state, the batter assumes a batting stance relative to the device 100, using the mock home plate 118 as a guide. The batter lines up so that the point of contact between the batter's bat and the pad 112 represents the point of contact between the batter's bat and a ball being pitched during a game-time situation. A batting coach can watch the batter from any angle offering advice and instruction at any point before, during or after the batter's swing. The pad 112 and impact dampener 114 absorb some of the impact of force applied by the bat to the device, which helps the batter avoid injury or strain caused by jarring during repeated hits against the device. In addition, the pad 112 and impact dampener 114 also halt the batter's swing. Once the batter makes contact with the pad 112, the batter can pause. Optionally with the assistance of a coach or other player, the batter is able to review and correct the position of his or her feet, hips, arms, legs, or whole body while maintaining substantial contact between the bat and the pad 112.

Figure 6:
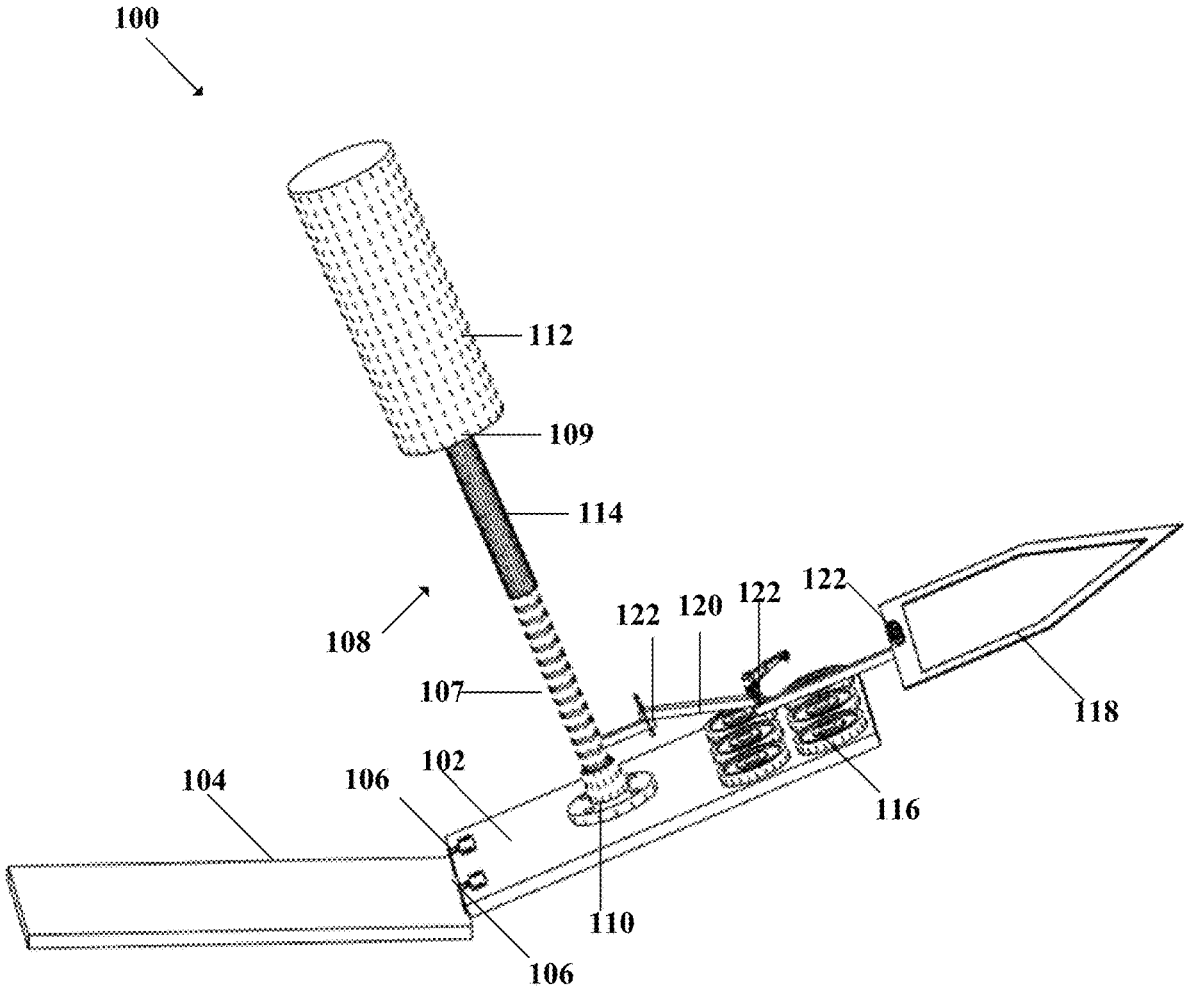
FIG. 6 depicts an embodiment of the hitting practice device of FIG. 4 in the intermediate state, during which the bat makes contact with the device.

FIG. 6 depicts an embodiment of the hitting practice device 100 in the intermediate state, during which the bat makes contact with the device. In this state, initial contact by the bat was made and the impact absorbed by the pad 112 and/or the impact dampener 114. The hinge 106 allows the batter to push the bat against the pad 112 to follow-through after the point of contact, causing the base plate 102 to pivot relative to the stabilization plate 104. In the embodiment of FIG. 6, the base plate 102 pivots toward the stabilization plate 104 as the batter follows through with the swing.

Figure 7:
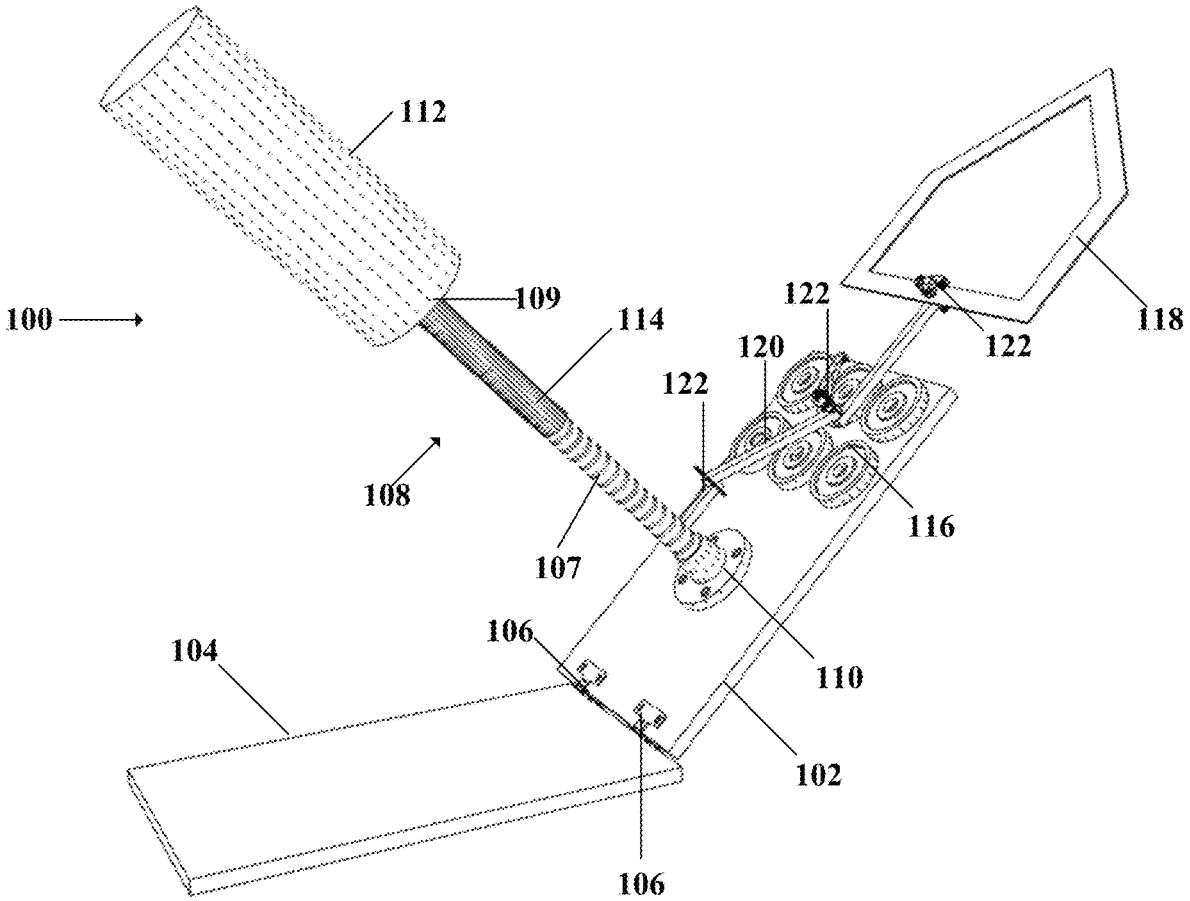
FIG. 7 depicts an embodiment of the hitting practice device of FIG. 4 in the stopped state, where the stopper prevents the device from tipping further, after the bat has made contact with the device.

FIG. 7 depicts an embodiment of the hitting practice device 100 in the stopped state, where the stopper prevents the device 100 from pivoting further, after the bat has made contact with the device 100. A limit in the hinge 106 acts as a stopper and prevents further rotation of the hinge 106, causing the base plate 102 to stop pivoting relative to the stabilization plate 104. At this point, the base plate 102 has not pivoted beyond the recovery angle, so the base plate 102 will naturally fall back into the resting position depicted in FIG. 5.

FIG. 8 depicts an embodiment of the device where the pad 112 and the upper portion 109 of the post 108 are detached and removed from the device. Here, the device 100 may be used as a tee upon which a baseball or softball can be placed. When using the device 100 as a tee, a batter places the baseball or softball upon the uppermost portion of the post 108 that has not been detached. The batter then assumes a stance relative the device and lines up such that the point of contact between the batter's bat and the ball placed on the device represents the point of contact between the batter's bat and a ball being pitched during a game-time situation.

Figure 9A:
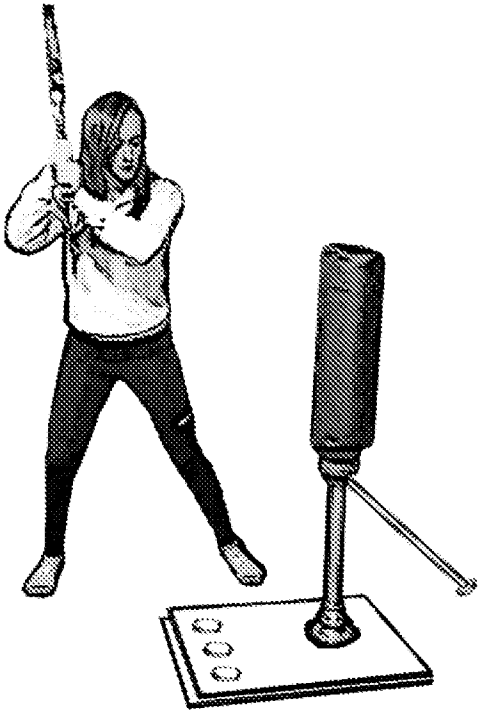
FIG. 9A depicts an embodiment of the hitting practice device being used by a batter, with the device in the resting state.
Figure 9B:
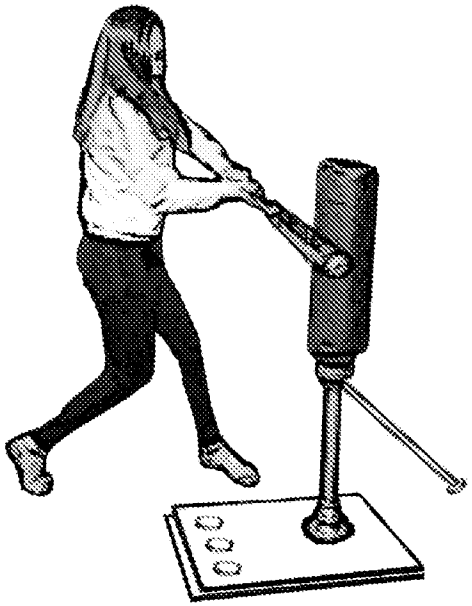
FIG. 9B depicts an embodiment of the hitting practice device being used by a batter at the moment of contact between the bat and pad of the device.
Figure 9C:
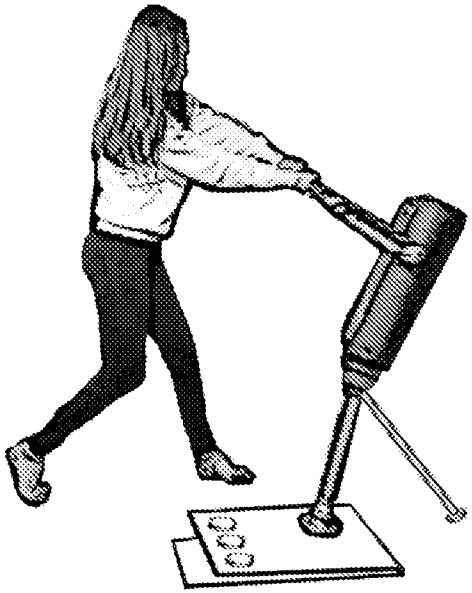
FIG. 9C depicts an embodiment of the hitting practice device being used by the batter, with the device in the intermediate state.
Figure 9D:
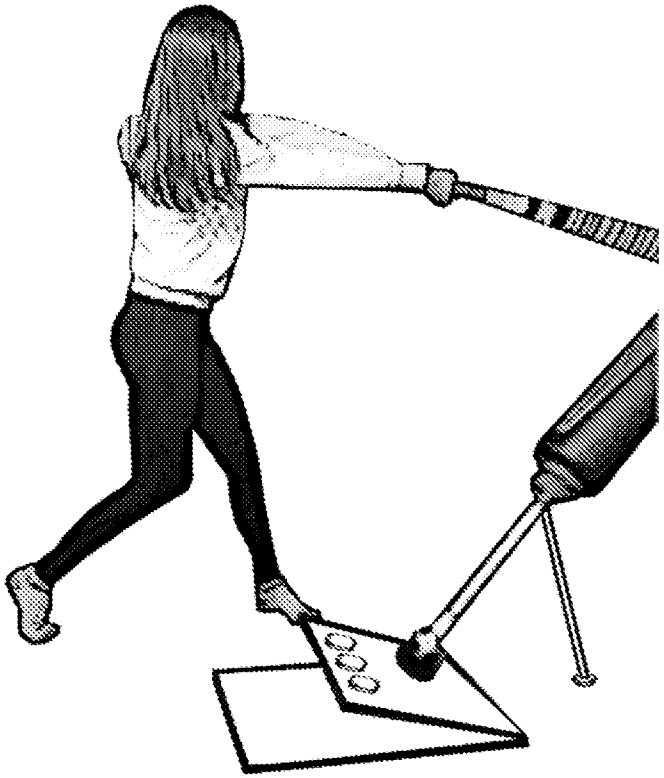
FIG. 9D depicts an embodiment of the hitting practice device being used by a batter, with the device in the stopped state.

Turning now to FIGS. 9A-9E, an embodiment of the hitting practice device 100 is depicted in use by a batter. In FIG. 9A, the device 100 is shown during the resting state prior to the batter making contact. In FIG. 9B, the batter makes initial contact with the pad 112. FIG. 9C shows the intermediate state during the batter's follow-through in which the base plate 102 pivots relative to the stabilization plate 104. In FIG. 9D, the device 100 is shown in the stopped state at which the leg stopper 124 makes contact with the floor or ground, and in FIG. 9E the device 100 returns to the resting state after the batter ceases contact with the padding 112 during the follow-through.

Figure 9E:
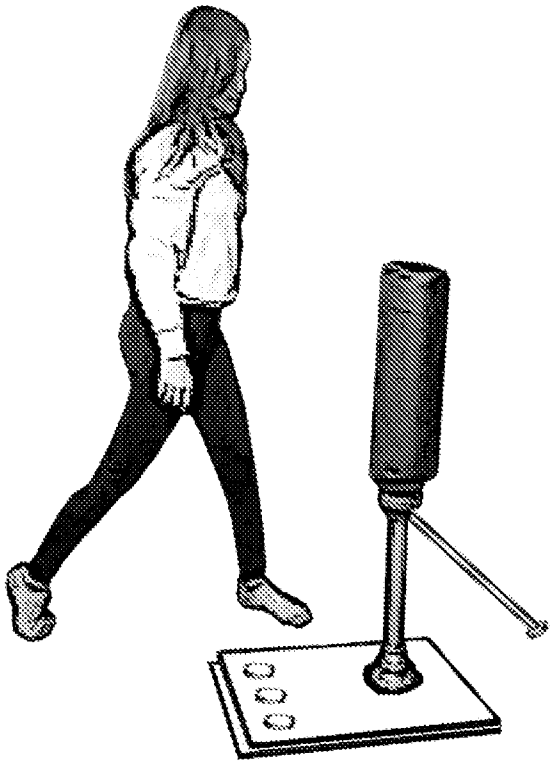
FIG. 9E depicts an embodiment of the hitting practice device being used by a batter, as the device returns to the resting state.

At the resting state depicted in FIG. 9A, the batter assumes a batting stance relative to the device. The batter lines up so that the point of contact between the batter's bat and the pad 112 represents the point of contact between the batter's bat and a ball being pitched during a game-time situation. A batting coach can watch the batter from any angle offering advice and instruction at any point before, during or after the batter's swing. FIG. 9B depicts the state at which the batter makes initial contact with the pad 112. The pad 112 and impact dampener 114 absorb some of the impact of force applied by the bat to the device, which helps the batter avoid injury or strain caused by jarring during repeated hits against the device. Once the batter makes contact with the pad 112, the batter can pause. Optionally with the assistance of a coach or other player, the batter is able to review and correct the position of his or her feet, hips, arms, legs, and/or whole body while maintaining substantial contact between the bat and the pad 112. Following review and any correction made, the batter then enters the intermediate state, as depicted in FIG. 9C, in which the batter follows through and completes the swinging motion by pushing against the pad 112 with the bat. The batter is able to extend past the initial point of contact completing the rotation of their body and movement of the bat, rather than forcing the batter to end their swing at the point of contact. The stopper leg 124 then prevents the device 100 from toppling over, as depicted in FIG. 9D, by making contact with the ground or floor once the base plate 102 reaches its maximum pivoting angle (e.g., the recovery angle). The weight distribution on the device 100, aided by gravity, then causes the base plate 102 to pivot back and return the device 100 to its resting state, as depicted in FIG. 9E. The batter can then repeat these steps one or more additional times, as needed, without the need to manually readjust or reset the device 100 in between hits and follow-throughs.

Figure 10:
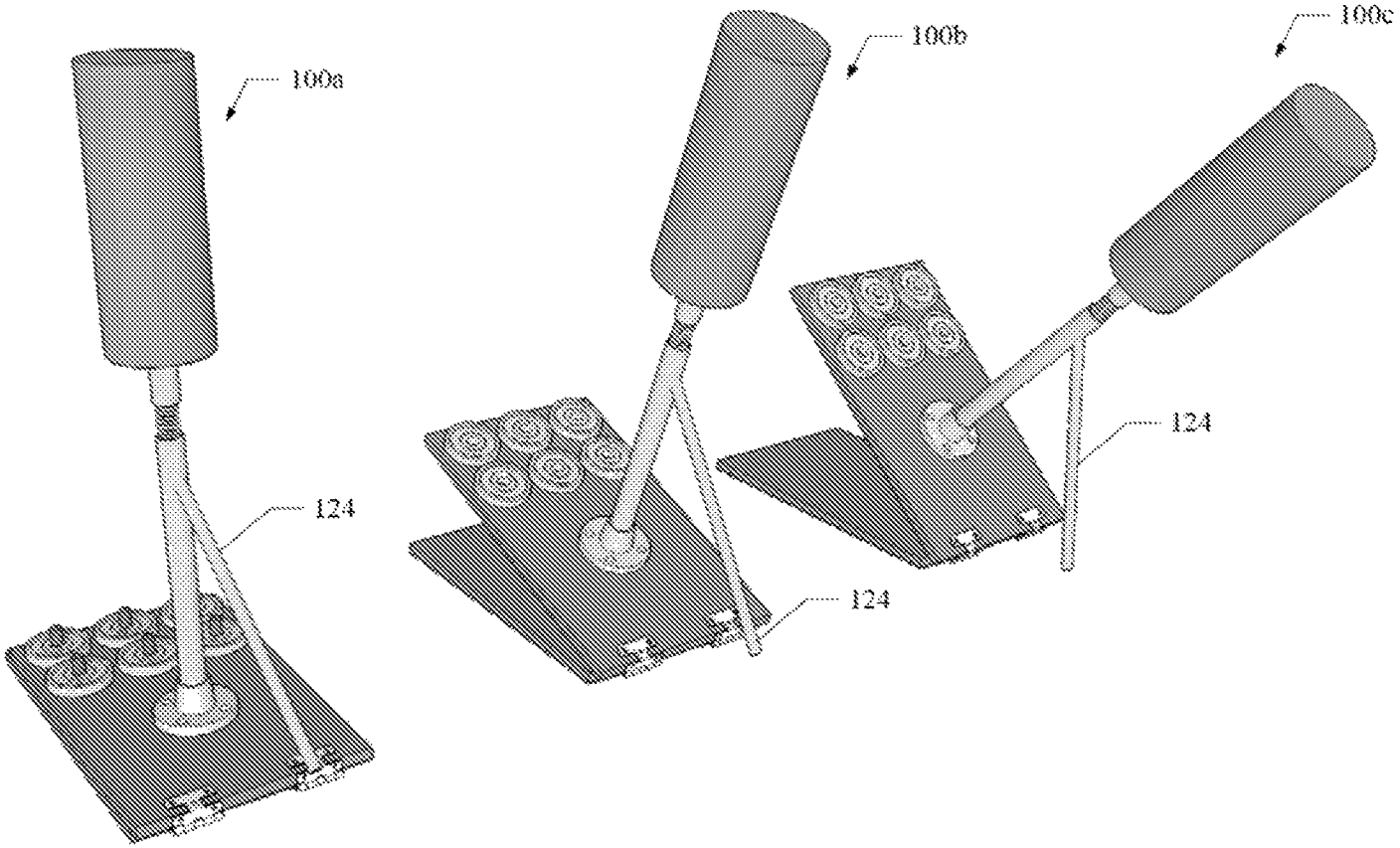
FIG. 10 depicts another embodiment of the hitting practice device including a stopper leg.

Turning now to FIG. 10, another embodiment of the hitting practice device 100*a-c* is shown, with a stopper leg 124. As depicted, the stopper leg 124 prevents the hitting practice device 100*a-c* from rotating beyond the recovery angle. In FIG. 10, the device 100*a* is shown first in the resting state, with a stopper leg 124 attached to the post 108. Next, the device 100*b* is shown in the intermediate state, where the batter has made contact and the post 108 rotates relative to the surface on which the device 100*b* rests. Finally, the device 100*c* is shown in the stopped state, where the stopper leg 124 has made contact with the ground or surface on which the device 100*c* rests. Here, the stopper leg 124 prevents the base plate 102 and device 100*c* from rotating past the recovery angle. In other embodiments, the stopper leg 124 can be attached to the base plate itself and can be implemented in the same manner as a door stop. In another embodiment, the stopper can be a chain, cord or other attachment between the base plate 102 and the stabilization plate 104 that controls the angle between the base plate 102 and stabilization plate 104 and prevents the base plate 102 from rotating past the recovery angle.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations in form thereof are used in either the detailed description or the claims, such terms are intended to be inclusive in a manner similar to the term "comprising" as "comprising" is interpreted when employed as a transitional word in a claim.

What is claimed is:

1. A hitting practice device that facilitates practice of an initial contact and a follow-through of a hit, comprising:

a pivoting base plate:

a hinge attached to the base plate and to a surface on which the base plate rests prior to the hit, wherein the base plate rotates about the hinge:

a post projecting upward from the pivoting base plate, the post having a padded upper portion; and a dampener attached to the post, wherein the dampener absorbs at least a part of the initial contact of the hit aimed at the padded upper portion, and wherein at least a part of the pivoting base plate is configured to pivot relative to the surface on which the pivoting base plate rests, the pivot occurring during the follow-through of the hit.

2. The hitting practice device of claim 1, further comprising a stopper configured to prevent the post from pivoting beyond a recovery angle.

3. The hitting practice device of claim 2, wherein the stopper further comprises a stopper leg connected to the post and extending outward so as to prevent the base plate from pivoting beyond the recovery angle.

4. The hitting practice device of claim 1, further comprising a mock home plate that is configured to be repositionable relative to the post and operably coupled to the pivoting base plate.

5. The hitting practice device of claim 4, wherein the mock home plate is operably coupled to the pivoting base plate with at least one adjustable joint.

6. The hitting practice device of claim 4, wherein both the distance between the mock home plate and the pivoting base plate and the angle of the mock home plate relative to the pivoting base plate are selectively adjustable.

7. The hitting practice device of claim 1, further comprising one or more weights attached to the base wherein the one or more weights resist a pivoting movement of the pivoting base plate.

8. The hitting practice device of claim 7, wherein the one or more weights are selectively detachable.

9. The hitting practice device of claim 1, wherein the padded upper portion is selectively detachable.

10. The hitting practice device of claim 1, wherein a bottom surface of the base plate rests on the surface prior to the hit, and the hinge is adjacent to a single edge of the bottom surface of the base plate.

11. A hitting practice device, comprising:

a base plate connected to a supporting surface by at least one hinge, wherein the base plate is pivotable relative to the supporting surface about the at least one hinge and the hinge is attached along a single edge of the base plate;

a post connected to the base plate, wherein the post is substantially perpendicular to the base plate; and a pad covering at least a part of the post.

12. The hitting practice device of claim 11, wherein the supporting surface is a stabilization plate.

13. The hitting practice device of claim 12, wherein the base plate is positioned on top of the stabilization plate when in an initial position and is configured to pivot away from the stabilization plate when the post is hit with a sufficient force.

14. The hitting practice device of claim 12, wherein the base plate is substantially coplanar with the stabilization plate when in an initial position and is configured to pivot toward the stabilization plate when the post is hit with a sufficient force.

15. The hitting practice device of claim 11, further comprising a stopper configured to prevent the base plate from pivoting beyond a recovery angle.

16. The hitting practice device of claim 11, further comprising a mock home plate that is configured to be repositionable relative to the post and operably coupled to the pivoting base plate.

17. The hitting practice device of claim 11 further comprising a dampener configured to pause a batter's swing.

18. A hitting practice device, comprising:

a base plate configured to pivot about a hinge and relative to a supporting surface;

a post connected to the base plate, wherein the post is substantially perpendicular to the base plate; and a dampener configured to absorb at least a portion of a hit administered to the post.

19. A hitting practice device of claim 18, further comprising a resistance element configured to oppose pivoting of the base plate.

20. The hitting practice device of claim 18, wherein the hinge is attached to a single edge of the base plate and to the supporting surface, wherein movement of the hinge causes the base plate to pivot relative to the supporting surface.

* * * * *